US008957755B2

(12) United States Patent
Lu et al.

(10) Patent No.: US 8,957,755 B2
(45) Date of Patent: Feb. 17, 2015

(54) MULTI-LAYER BLADE FUSE AND THE MANUFACTURING METHOD THEREOF

(75) Inventors: Xiurong Lu, Nanjing (CN); Shirong Nan, Nanjing (CN); Manxue Yang, Nanjing (CN)

(73) Assignee: Nanjing Sart Science & Technology Development Co., Ltd. (CN)

( * ) Notice: Subject to any disclaimer, the term of this patent is extended or adjusted under 35 U.S.C. 154(b) by 47 days.

(21) Appl. No.: 13/063,213

(22) PCT Filed: Nov. 20, 2009

(86) PCT No.: PCT/CN2009/001291

§ 371 (c)(1),
(2), (4) Date: Mar. 10, 2011

(87) PCT Pub. No.: WO2010/060275

PCT Pub. Date: Jun. 3, 2010

(65) Prior Publication Data

US 2011/0210814 A1 Sep. 1, 2011

(30) Foreign Application Priority Data

Nov. 25, 2008 (CN) ..... 2008 1 0235440
Nov. 25, 2008 (CN) ..... 2008 2 0217547 U

(51) Int. Cl.

*H01H 85/044* (2006.01)
*H01H 85/046* (2006.01)
*H01H 85/08* (2006.01)
*H01H 85/055* (2006.01)
(Continued)

(52) U.S. Cl.

CPC ..... *H01H 85/046* (2013.01); *H01H 85/08* (2013.01); *H01H 85/055* (2013.01); *H01H 69/022* (2013.01); *H01H 85/0411* (2013.01); *H01H 2085/0414* (2013.01)

USPC ..... 337/296; 337/292; 337/297

(58) Field of Classification Search

CPC ..... H01H 85/046; H01H 85/0411; H01H 69/022; H01H 85/055; H01H 85/08; H01H 2085/0414

USPC ..... 337/296, 292, 297

See application file for complete search history.

(56) References Cited

U.S. PATENT DOCUMENTS 3,368,919 A * 2/1968 Casale et al. ..... 361/322
4,263,574 A * 4/1981 Mori et al. ..... 337/161
5,166,656 A * 11/1992 Badihi et al. ..... 337/297
(Continued)

FOREIGN PATENT DOCUMENTS

CN 1925087 3/2007
CN 101441960 5/2009
JP 6150802 5/1994

*Primary Examiner* — Anatoly Vortman

(74) *Attorney, Agent, or Firm* — Schmeiser, Olsen & Watts, LLP

(57) ABSTRACT

A multi-layer fuse and its manufacturing method are provided. The multi-layer fuse comprises a ceramic substrate, back electrodes, front electrodes, fuse wire, protective layers and metal ends, wherein the fuse wire is prepared in multiple layers and the adjacent layers of fuse wire are connected in a head-to-tail style; the two lead-outs of the fuse wire as a whole are respectively connected to the two front electrodes located at the two ends of the substrate, and each layer of the fuse wire is deposited with a protective layer. During manufacturing, all protective layers but the upmost one leaves the tail of each layer of fuse wire uncovered so that the head-to-tail series connection is possible.

5 Claims, 7 Drawing Sheets

(51) Int. Cl.
*H01H 85/041* (2006.01)
*H01H 69/02* (2006.01)

(56) References Cited

U.S. PATENT DOCUMENTS 5,296,833 A * 3/1994 Breen et al. ..... 337/297
5,432,378 A * 7/1995 Whitney et al. ..... 257/529
5,586,014 A * 12/1996 Hasegawa ..... 361/534
5,726,621 A * 3/1998 Whitney et al. ..... 337/297
5,864,277 A * 1/1999 Grimm et al. ..... 337/297
5,914,649 A * 6/1999 Isono et al. ..... 337/290
5,977,860 A * 11/1999 Ulm et al. ..... 337/297
6,034,589 A * 3/2000 Montgomery et al. ..... 337/296
7,116,208 B2 * 10/2006 Nishimura et al. ..... 337/296
7,268,661 B2 * 9/2007 Li et al. ..... 337/296
7,367,114 B2 * 5/2008 Rybka et al. ..... 29/623
8,081,057 B2 * 12/2011 Chiu ..... 337/297
2004/0034993 A1 * 2/2004 Rybka et al. ..... 29/623
2009/0027821 A1 * 1/2009 Colby et al. ..... 361/104
2011/0063070 A1 * 3/2011 Dietsch et al. ..... 337/290

* cited by examiner

MULTI-LAYER BLADE FUSE AND THE MANUFACTURING METHOD THEREOF

FIELD OF TECHNOLOGY

This invention relates to the field of fuses, and particularly to a fuse used to protect electronic components, and its manufacturing method.

BACKGROUND

Most fuses are currently made by adopting chip-resistor manufacturing methods, and they have only one layer of printed fuse wire. Though the fuse wire so manufactured can be patterned in such various forms as straight, battlement-shaped or serpentine line, it is limited in total length and unable to be used on many occasions when high anti-surge capability is required. There exists other types of fuses. They have multiple layers of printed fuse wire, and are able to be used on many occasions when high anti-surge capability is required. Specifically, these fuses have a monolithic structure that consists of three or more layers of glass ceramic, each layer having been deposited with a metal film. These monolithic structure fuses are covered with a conductive layer at both ends, which are bridged by the metal films lying in parallel in between. These monolithic structure fuses are manufactured as follows: a metal film is deposited on the green body of the substrate made of glass ceramic, and wet tape-casting technology is thereafter adopted to form a very thin layer of glass ceramic thereupon; the same process is repeated so that a desired number of layers is obtained. After a monolithic green body is obtained, it is subject to horizontal and vertical cutting so that the green bodies of independent fuses are formed. The green bodies are then sintered into ceramic, and then the two end are encapsulated by electroplating.

The manufacturing method of the monolithic structure is a complicated process, requiring a large investment on equipment, and having a long manufacturing duration, which makes it difficult to use extensively.

SUMMARY

This invention is intended to provide a multi-layer fuse that has a simple manufacturing process, requires a small investment on equipment, and has a short manufacturing duration. Thus, the multi-layer fuse can be used on most occasions when high anti-surge capability is required.

A first aspect relates to a multi-layer fuse, comprising a ceramic substrate, a plurality of back electrodes, a plurality of front electrodes, a fuse wire, a plurality of protective layers and metal ends. The fuse wire has multiple layers and the adjacent layers are connected in a head-to-tail style. The two lead-out ends of the fuse wire are connected to the two front electrodes located on the two ends of the substrate, wherein each layer of the fuse wire is deposited with the protective layer.

It is recognized by those skilled in the art, the metal ends include inner electrodes and end electrodes comprised of Nickel (Ni).

A second aspect relates to a multi-layer fuse, wherein the back electrodes, the front electrodes and metal ends are printed with the conventional single-layer printing technology, and all layers of the fuse wire and all protective layers are printed with the conventional single-layer printing technology as well. The multi-layer printing technology embodied herein is reflected in the following processes: the lowest layer of the fuse wire (hereafter referred to as "the lower lead-out fuse wire"), the first protective layer, the middle layer of the fuse wire (hereafter referred to as "the middle fuse wire"), the middle protective layer, the upper layer of the fuse wire (hereafter referred to as "upper lead-out fuse wire"), and the third protective layer are printed on the ceramic substrate in succession. The head of the lower lead-out fuse wire is connected to one front electrode at one end of the substrate while its tail stays unconnected to the other front electrode at the opposite end of the substrate. The first protective layer is printed on the lower lead-out fuse wire, and is shorter than the lower lead-out fuse wire so that the tail of the lower lead-out fuse wire projects out. The middle fuse wire is printed upon the first protective layer, not connecting to either of the two front electrodes, but its head connecting to the tail of the lower lead-out fuse link. The middle protective layer is printed upon the middle fuse wire, keeping the tail of the middle fuse wire projecting out. The upper lead-out fuse wire is printed upon the middle protective layer, its head connecting to the tail of the middle fuse wire while its tail connects to the other front electrode at the opposite end of the substrate. In doing so, the three layers of the fuse wire connect to one another in a head-to-tail style. In other words, the three layers of the fuse wire are in series connection, which effectively elongates the total length of the fuse wire, and its anti-surge capability is consequently enhanced.

The middle fuse wire and middle protective layer refer to the fuse wire and its corresponding protective layers between the first protective layer and the last layer of the fuse wire (upper lead-out fuse wire). They can be either one layer or an odd-number multiple, for example, 3 or 5 layers. However, as is recognized by those skilled in the art, each layer of the middle fuse wire should be printed with a protective layer.

The third protective layer refers to the protective layer printed upon the upper lead-out layer, a.k.a the upmost protective layer of the whole fuse; the number "third" does not necessarily mean "the third" ordinally, it depends upon the specific layers contained in the middle protective layer. It may mean either exactly the ordinal "third", as is shown in the embodiment herein, or the fifth layer, provided that the middle protective layers contain three layers in total. In this way, the exact meaning of the third protective layer can be analogically deduced.

In this invention, all components of the fuse can be made of conventional materials.

DETAILED DESCRIPTION

The terms used herein, except as specifically explained, are generally recognized by those skilled in this field.

Preferred embodiments are provided in the following to facilitate a detailed description of this invention. Thus, although specific embodiments are described herein, it will be recognized that the scope of this invention is not restricted to the description.

In the following embodiments, the steps and technologies that are not elaborated, for example, screen-printing technology, are conventional to those skilled in this field.

Embodiment 1

The Manufacture of Three-Layer Fuse

Figure 1:
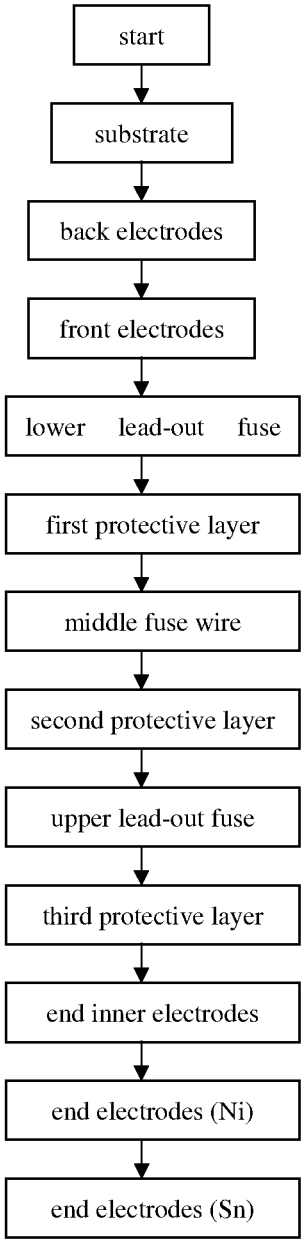
FIG. 1 a flow chart showing an embodiment of the manufacturing method disclosed in this invention.
Figure 2:
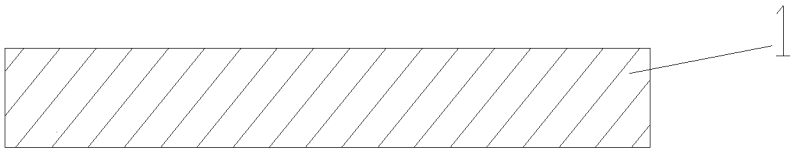
FIG. 2 depicts an embodiment of the substrate.

As is shown in FIG. 1, the manufacturing steps include:

I. Providing the substrate 1, which is made of alumina or steatite, as is shown in FIG. 2;

II. Forming the back electrodes

Figure 3:
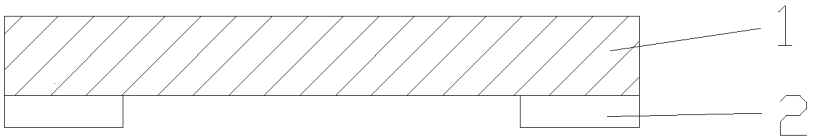
FIG. 3 depicts an embodiment of forming back electrodes.

As is shown in FIG. 3, a conductive paste, which contains silver, is screen-printed on both ends of the back side of the substrate 1 to form the pattern of the back electrodes 2;

III. Drying the substrate in a drying oven at a temperature of 150° C. for 15 minutes;

IV. Forming the front electrodes

Figure 4:
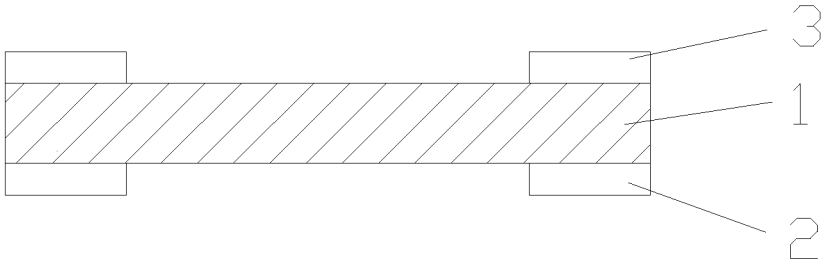
FIG. 4 depicts an embodiment of forming front electrodes.

As is shown in FIG. 4, the front electrodes 3 are screen-printed on the front side of the substrate 1, wherein the conductive paste contains silver or silver-palladium alloy;

V. Drying the substrate in a drying oven at a temperature of 150° C. for 15 minutes;

VI. Sintering the substrate in a sintering oven with a maximal temperature of 600° C.-850° C. for 60 minutes;

VII. Patterning the lower lead-out fuse wire

Figure 5:
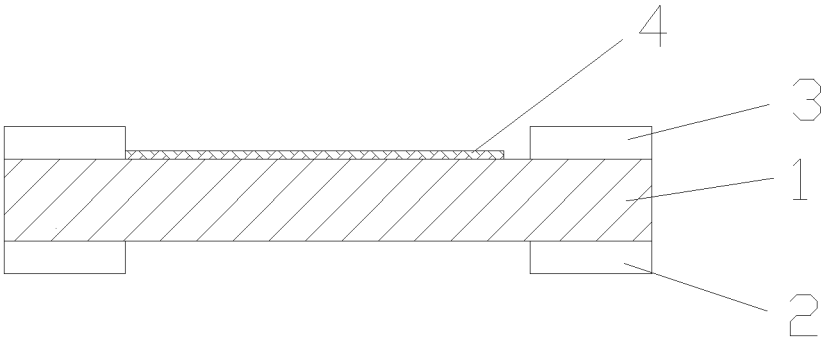
FIG. 5 depicts an embodiment of forming the lower lead-out fuse wire.
Figure 6:
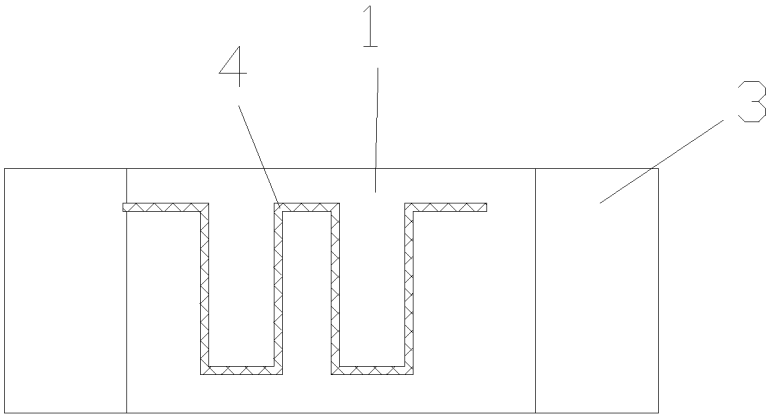
FIG. 6 depicts a plan view of FIG. 5.

As is shown in FIG. 5 and FIG. 6, the lower lead-out fuse wire 4, located between the two front electrodes, is screen-printed on the ceramic substrate, its head connecting to one front electrode while its tail keeps a certain distance (therefore, unconnected) to the other front electrode. The pattern of the lower lead-out fuse wire can be designed in such various forms as straight, battlement-shaped or serpentine line (battlement-shape wire is adopted in this preferred embodiment). The main components of the conductive paste are metals, such as silver, palladium, copper and platinum, or their mixture;

VIII. Drying the substrate in a drying oven at a temperature of 150° C. for 15 minutes;

IX. Sintering the substrate in a sintering oven with a maximal temperature of 600° C.-850° C. for 60 minutes;

X. Forming the first protective layer

Figure 7:
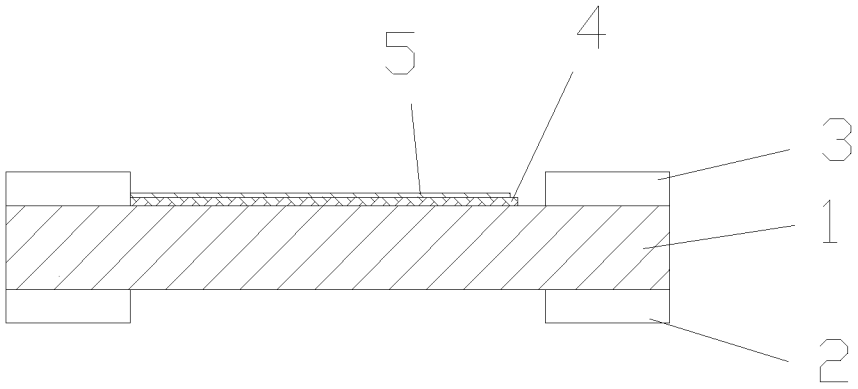
FIG. 7 depicts an embodiment of forming the first protective layer.
Figure 8:
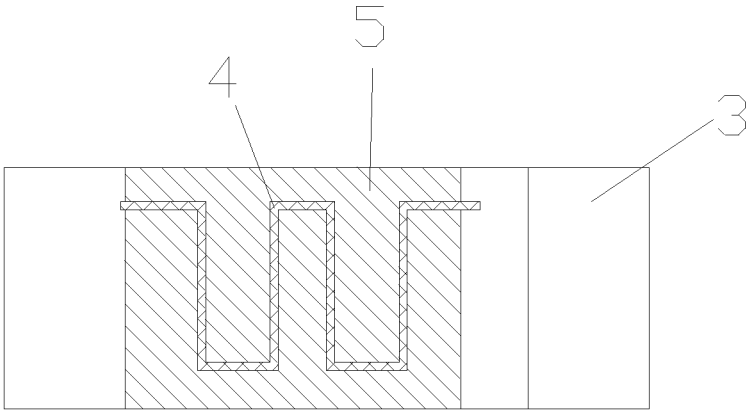
FIG. 8 depicts a plan view of FIG. 7.

As is shown in FIG. 7 and FIG. 8, the first protective layer 5 (made of ethoxyline resin or phenolic resin) is screen-printed on the lower lead-out fuse wire 4, keeping the first protective layer 5 shorter than the lower lead-out fuse wire 4 so that the tail of the lower lead-out fuse wire 4 projects out;

XI. Patterning the middle fuse wire

Figure 9:
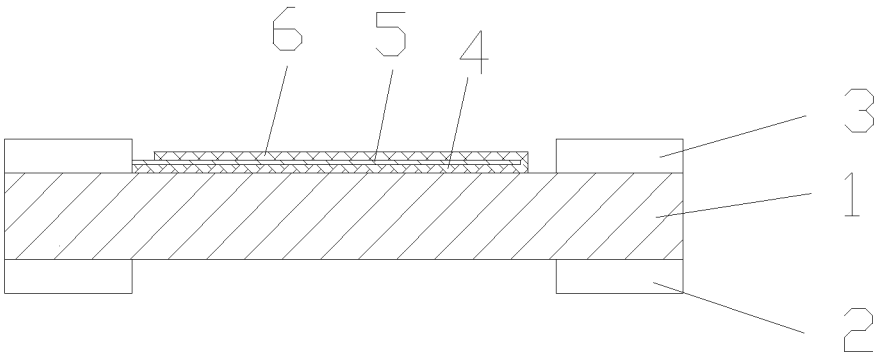
FIG. 9 depicts an embodiment of forming the middle fuse wire.
Figure 10:
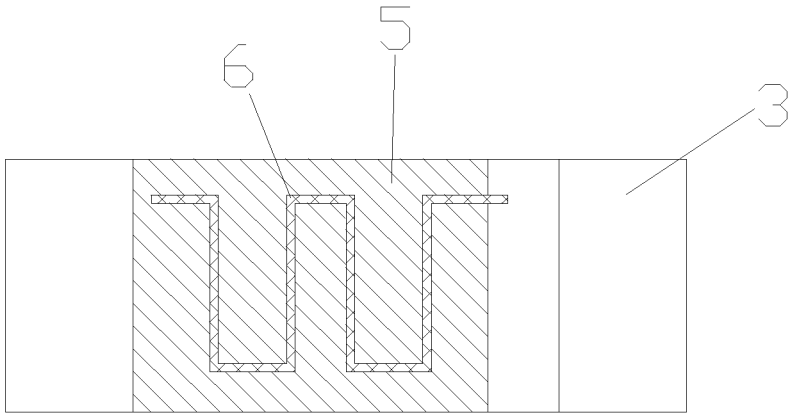
FIG. 10 depicts a plan view of FIG. 9.

As is shown in FIG. 9 and FIG. 10, the pattern of the middle fuse wire 6 is screen-printed on the first protective layer 5, its head connecting to the tail of the lower lead-out fuse wire that projects out of the first protective layer. The pattern of the middle fuse wire 6 is located at the central place of the substrate, keeping unconnected to neither of the front electrodes 3;

XII. Drying the substrate in a drying oven at a temperature of 150° C. for 15 minutes;

XIII. Sintering the substrate in a sintering oven with a maximal temperature of 600° C.-850° C. for 60 minutes;

XIV. Forming the middle protective layer (a.k.a the second protective layer in this preferred embodiment)

Figure 11:
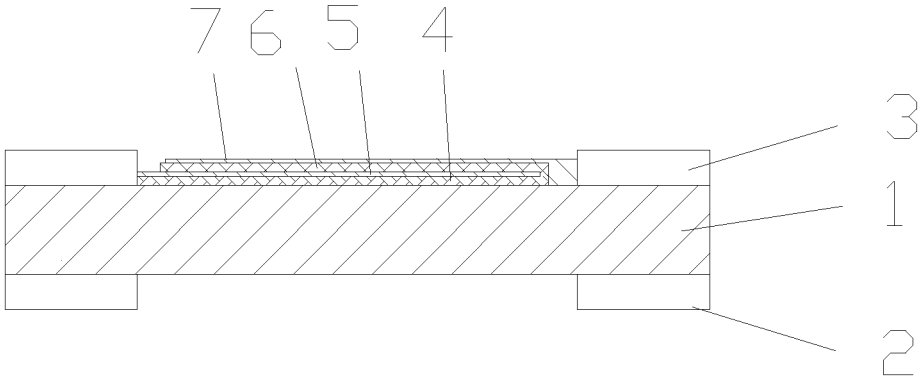
FIG. 11 depicts an embodiment of forming the middle protective layer.
Figure 12:
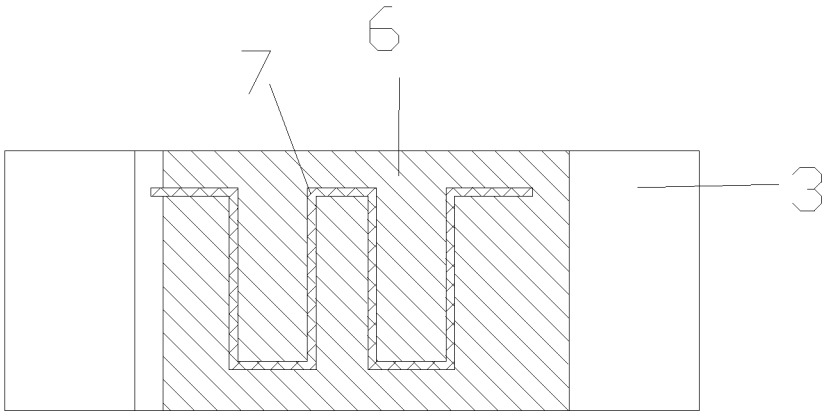
FIG. 12 depicts a plan view of FIG. 11.

As is shown in FIG. 11 and FIG. 12, the second protective layer 7 (made of the same material as the first protective layer) is screen-printed on the pattern of the middle fuse wire 6, keeping the tail of the middle fuse wire 6 uncovered;

XV. Patterning the upper lead-out fuse wire

Figure 13:
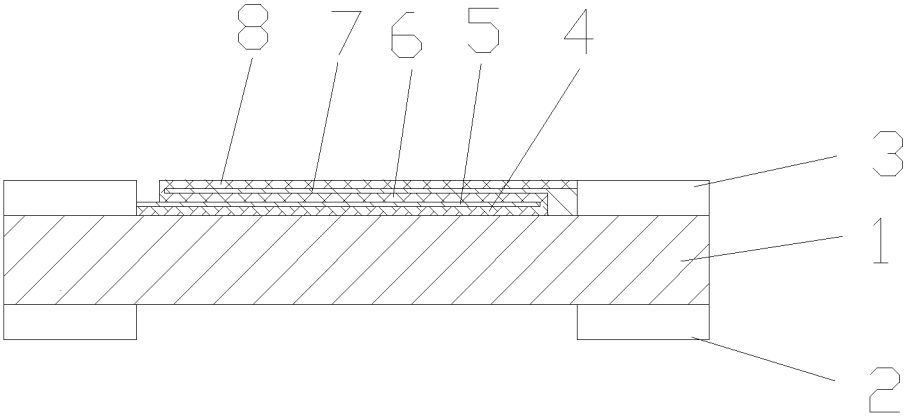
FIG. 13 depicts an embodiment of forming the upper lead-out fuse wire.
Figure 14:
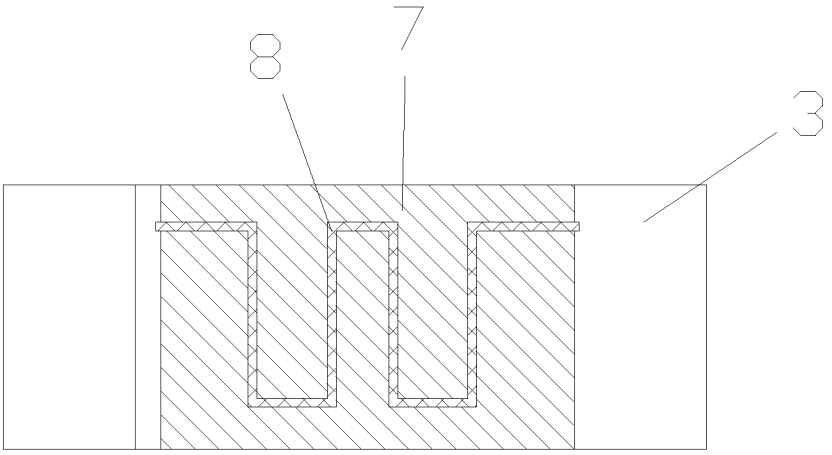
FIG. 14 depicts a plan view of FIG. 13.

As is shown in FIG. 13 and FIG. 14, the pattern of the upper lead-out fuse wire 8 is screen-printed on the second protective layer 7, its head connecting to the tail of the middle fuse wire 6 that projects out of the second protective layer 7 while its tail connecting to the other front electrode 3 at the opposite end of the substrate (one of the two front electrodes 3 has already been connected to the head of the lower lead-out fuse wire);

XVI. Drying the substrate in a drying oven at a temperature of 150° C. for 15 minutes;

XVII. Sintering the substrate in a sintering oven with a maximal temperature of 600° C.-850° C. for 60 minutes;

XVIII. Forming the third protective layer

Figure 15:
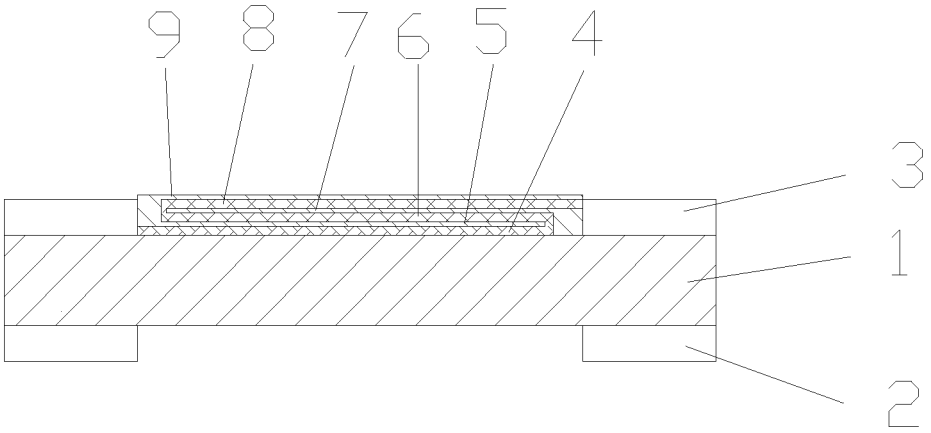
FIG. 15 depicts an embodiment of forming the third protective layer.

As is shown in FIG. 15, the third protective layer 9 made of the same material as the first and second protective layer is screen-printed on the upper lead-out fuse wire 8, covering all the front side of the substrate 1 except the two front electrodes;

XIX. Forming the end inner electrodes

Figure 16:
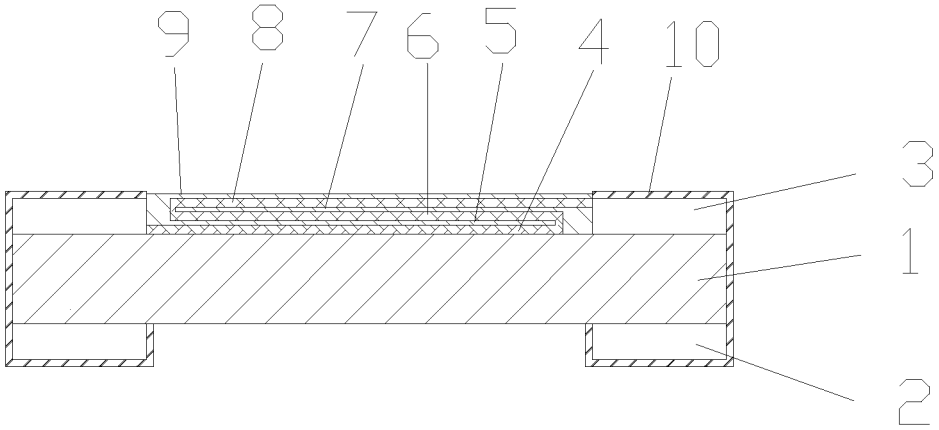
FIG. 16 depicts an embodiment of forming the end inner electrodes.

As is shown in FIG. 16, the end inner electrodes 10 made of silver are dip encapsulated on the substrate 1;

XX. Forming the end electrodes

Figure 17:
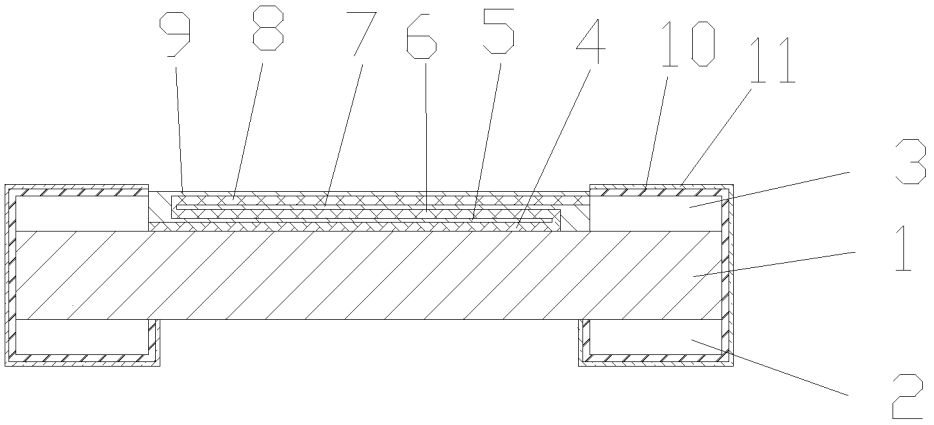
FIG. 17 depicts an embodiment of forming the end electrodes.
Figure 18:
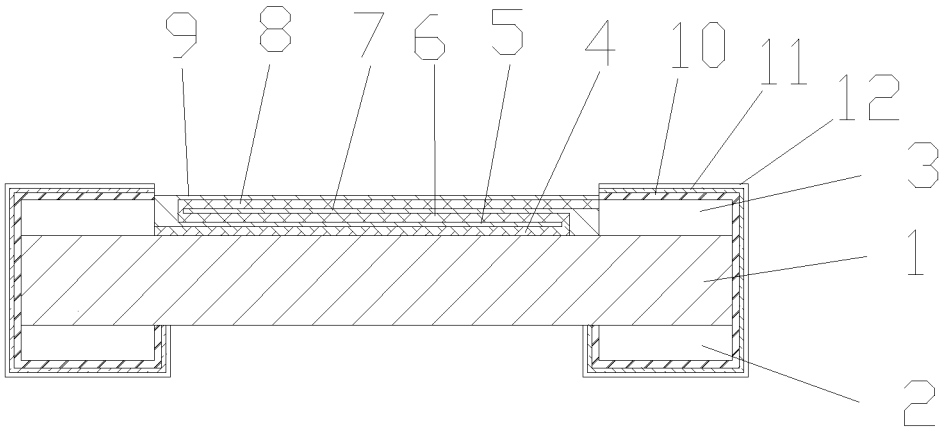
FIG. 18 a structure diagram of an embodiment of the fuse, wherein: 1. the substrate; 2. back electrodes; 3. front electrodes; 4. the lower lead-out fuse wire; 5. the first protective layer; 6. the middle fuse wire; 7. the second protective layer; 8. the upper lead-out fuse wire; 9. the third protective layer; 10. inner electrodes; 11. end electrodes (Ni); 12. end electrodes (Sn).

As is shown in FIG. 17 and FIG. 18, the end electrodes 11 and 12 made of nickel and tin respectively are barrel-plated on the substrate 1, covering the back electrodes, front electrodes and end inner electrodes; the three-layer fuse is therefore obtained, as shown in FIG. 18.

Amongst the steps described above, steps X, XIV and XVIII are accompanied with the same drying and sintering processes as mentioned above.

The middle fuse wire and middle protective layer described herein contain only one layer respectively; however, as mentioned above, two or more layers of fuse wire and protective layers can be added in between. In accordance with the head-to-tail technology disclosed in this preferred embodiment, those skilled in the art are able to manufacture a fuse containing multi-layered middle fuse wire and multi-layered middle protective layer.

Embodiment 2

The products [S 1206-S-0.5A] manufactured through Embodiment 1 were tested in accordance with testing items and technical requirements stipulated in Chinese national standards GB9364.4-2006 and GB9364.1-1997. The results show that these products completely satisfy the stipulated specifications, particularly, compared with the conventional single-layer blade fuse, and these products present significant improvement insofar as the anti-surge capability (surge caused by 10 times of rated current) is concerned. The test results of the fuses manufactured with the two different technologies are compared as follows:

TABLE 1 comparison of anti-aging capability

| | Fuses made with conventional single-layer technology | | fuses made with multi-layer technology disclose herein | |
|---|---|---|---|---|
| No. | 2In breaking time (mS) | 10In breaking time (μS) | 2In breaking time (mS) | 10In breaking time (μS) |
| 1 | 18.45 | 220 | 20.43 | 1280 |
| 2 | 16.17 | 190 | 32.32 | 1020 |
| 3 | 14.35 | 390 | 24.33 | 930 |
| 4 | 32.32 | 380 | 25.23 | 980 |
| 5 | 14.65 | 180 | 21.25 | 900 |
| 6 | 18.90 | 170 | 26.88 | 1120 |
| 7 | 20.78 | 280 | 31.67 | 1000 |
| 8 | 20.66 | 300 | 23.26 | 990 |
| 9 | 17.56 | 200 | 22.54 | 930 |
| 10 | 23.55 | 140 | 23.77 | 820 |
| conclusion | According to data shown above, the two types of fuses show no big difference when 2 times rated current is applied; but when 10 times rated current is applied, the breaking time of the fuses made with technology disclosed herein is much longer than that of the conventional single-layer fuses; a.k.a. they present better anti-surge capability. | | | |

Note:
the test is conducted as follow: choosing 20 fuses from each group and applying with the rated current for 200 hours (temperature 25° C., humidity 40%), thereafter testing the breaking time of these fuses with 2 times and 10 times rated current respectively. Instruments used for this test are BXC-35A fusing testing device and DS5062M digital oscilloscope Instruments used for this test are BXC-35A fusing testing device and DS5062M digital oscilloscope.

What is claimed is:

1. A multi-layer chip fuse, comprising:

a ceramic substrate having a first end and a second end, and a back side and a front side opposing the back side;

a plurality of back electrodes connected to the back side of the ceramic substrate;

a plurality of front electrodes comprised of a first front electrode and a second front electrode, the plurality of front electrodes connected to the front side of the ceramic substrate;

a first lead-out fuse wire having a first head end and a first tail end, the first head end of the first lead-out fuse wire is directly mechanically connected to the first front electrode while the first tail end of the first lead-out fuse wire is not mechanically connected to the second front electrode;

a first protective layer screen printed onto the first lead-out fuse wire, wherein a portion of the first tail end of the first lead-out fuse wire projects out from the first protective layer;

a middle fuse wire having a second head end and a second tail end, the second head end directly mechanically connected to the first tail end of the first lead-out fuse wire, wherein both the second head end and the second tail end of the middle fuse wire are not mechanically connected to the plurality of front electrodes;

a second protective layer screen printed onto the middle fuse wire, wherein a portion of the second tail end of the middle fuse wire projects out from the second protective layer;

a second lead-out fuse wire having a third head end and a third tail end, the third head end directly mechanically connected to the second tail end of the middle fuse wire, the third tail end being directly mechanically connected to the second front electrode while the third head end is not mechanically connected to the plurality of electrodes; and a third protective layer screen printed onto the second lead-out fuse wire, the third protective layer directly contacting the both the first front electrode and the second front electrode so as to cover the entire second lead-out fuse wire.

2. The multi-layer chip fuse of claim 1, further comprising:

a plurality of metal end electrodes covering the plurality of back electrodes and the plurality of front electrodes.

3. The multi-layer chip fuse of claim 1, wherein a material used to form the plurality of protective layers is at least one of ethoxyline resin and phenolic resin.

4. The multi-layer chip fuse of claim 1, wherein the first lead-out fuse wire, the middle fuse wire, and the second lead-out fuse wire are disposed at least one of:

between the plurality of back electrodes and connected to the back side of the ceramic substrate between the first end and the second end of the ceramic substrate, and between the plurality of front electrodes and connected to the front side of the ceramic substrate between the first end and the second end of the ceramic substrate.

5. A method for manufacturing the multi-layer chip fuse as defined in claim 1, comprising such steps as:

forming the plurality of back electrodes on both ends of the back side of the ceramic substrate and forming the plurality of front electrodes on both ends of the front side of the ceramic substrate;

forming the first lead-out fuse wire, the middle fuse wire, and the second lead-out fuse wire, and the first protective layer, the second protective layer, and the third protective layer; and forming the plurality of metal ends.

* * * * *

UNITED STATES PATENT AND TRADEMARK OFFICE

CERTIFICATE OF CORRECTION

PATENT NO. : 8,957,755 B2
APPLICATION NO. : 13/063213
DATED : February 17, 2015
INVENTOR(S) : Xiurong Lu et al.

It is certified that error appears in the above-identified patent and that said Letters Patent is hereby corrected as shown below:

In the Specification,

Column 3, Line 8, after "FIG. 18", add --depicts--

Column 3, Line 54, after "wire", add --.--

Column 3, Line 64, before "metals", insert --some--

Column 5, Line 18, delete "disclose" and insert --disclosed--

Column 5, Line 36, delete "follow:" and insert --follows:--

In the Claims,

Column 6, Line 25, delete "the"

Signed and Sealed this
Twenty-second Day of March, 2016

Michelle K. Lee

Michelle K. Lee
*Director of the United States Patent and Trademark Office*